US008491397B2

(12) United States Patent
Caldwell et al.

(10) Patent No.: US 8,491,397 B2
(45) **Date of Patent: *Jul. 23, 2013**

(54) GRIP PRESSURE SENSOR

(76) Inventors: Theodore Caldwell, Laguna Beach, CA (US); Ning Chen, Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/269,598

(22) Filed: Oct. 9, 2011

(65) Prior Publication Data

US 2012/0087213 A1 Apr. 12, 2012

Related U.S. Application Data

(63) Continuation of application No. 11/733,145, filed on May 4, 2007, now Pat. No. 8,033,916.

(51) Int. Cl.
*A63F 13/00* (2006.01)

(52) U.S. Cl.
USPC ..... 463/46; 463/3; 463/7; 463/47; 273/108.2; 273/245; 273/317.2; 273/460; 473/131; 473/140; 473/212; 473/213; 434/252

(58) Field of Classification Search
USPC ..... 463/2–3, 5, 7, 23, 30–32, 36–37, 463/42–43, 46–47, 50, 53, 56; 273/108.2, 273/108.21, 150, 245, 317.1, 317.2, 329–331, 273/359, 366–368, 406–408, 441, 444–446, 273/453, 460–461; 473/131, 136, 140–141, 473/143, 145–146, 150–153, 156, 158, 160, 473/202, 204–217, 219–226, 231, 234, 257, 473/266, 280, 353, 405; 434/252; 702/141, 702/142, 160, 182
IPC ..... A63F 13/00; A63B 67/02
See application file for complete search history.

(56) References Cited

U.S. PATENT DOCUMENTS

| | | | | |
|---|---|---|---|---|
| 4,222,569 | A * | 9/1980 | DeMascolo | 473/213 |
| 5,907,282 | A * | 5/1999 | Tuorto et al. | 340/576 |
| 6,037,703 | A * | 3/2000 | Kambe et al. | 310/338 |
| 6,491,647 | B1 * | 12/2002 | Bridger et al. | 600/585 |
| 6,913,559 | B2 * | 7/2005 | Smith | 482/4 |
| 7,341,561 | B2 * | 3/2008 | Tanaka et al. | 600/503 |
| 2006/0199659 | A1 * | 9/2006 | Caldwell | 473/221 |

* cited by examiner

*Primary Examiner* — Arthur O. Hall
*Assistant Examiner* — Steve Rowland
(74) *Attorney, Agent, or Firm* — Brian Pangrle

(57) ABSTRACT

A watch includes a wrist band and a housing mounted to the wrist band where the housing includes a wrist side and an opposing side, a pliable domed shape pressure plate that extends outwardly from the wrist side of the housing to contact a palm side of a wrist and that responds to movements of muscles and tendons in the wrist that correspond to varying grip pressures applied by a hand extending from the wrist, a battery, memory, circuitry powered by the battery to convert responses of the pliable domed shape pressure plate to digital data, and circuitry powered by the battery to record the digital data to the memory.

18 Claims, 3 Drawing Sheets

A PIEZO SENSOR STRIP 1 ½ INCHES LONG IS FITTED INSIDE THE DOMED PRESSURE PLATE. THIN GUAGE ELECTRICAL WIRE LEADS FROM THE SENSOR TO A 3V BATTERY, THEN TO AN A/D CONVERTER.

FIGURE 2. SCHEMATIC DIAGRAM OF PRESSURE SENSOR CIRCUIT.

FIGURE 3. LCD LAYOUT SHOWING DIRECTION INDICATOR OF GRIP PRESSURE AND DIGITAL VALUE.

FIGURE 4. ILLUSTRATION OF DATA COLLECTION BY GRIP SENSOR
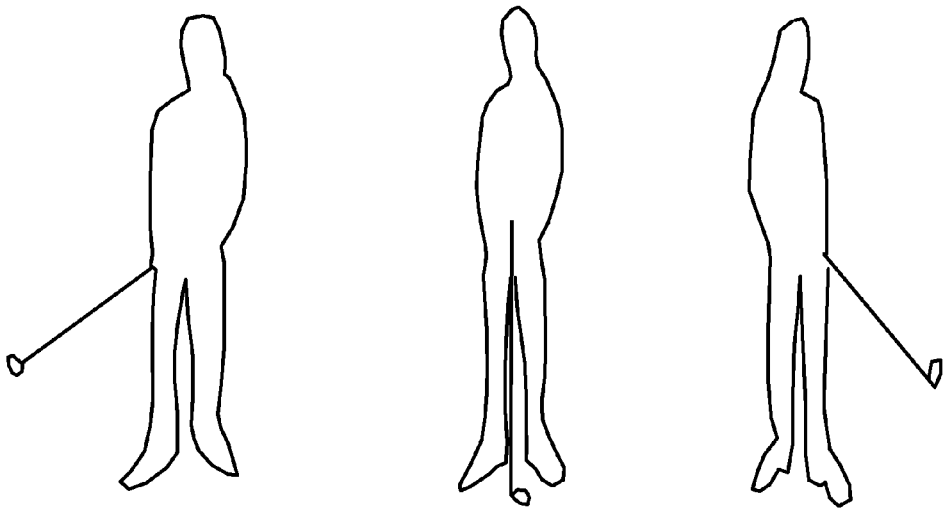
R1. . R2 . . . . . R3 . . . . . R4 . . R5
Time=N zero . . . . . Time = N+1

GRIP PRESSURE SENSOR

RELATED APPLICATIONS

This application is a continuation of U.S. application Ser. No. 11/733,145, filed on May 4, 2007, now U.S. Pat. No. 8,033,916 which is incorporated herein by reference.

BACKGROUND

1. Field of the Invention

This invention is directed to a swing training or teaching device, in general, and to such a training device in the form wrist watch and strap or band to be worn on the wrist of the user and which incorporates components and assemblies for measuring the grip pressure parameter of the swing.

2. Prior Art Statement

Various sports have developed equipment that until very recently, say the last 25 years, was rather basic, if not primitive. Now that modern technology has come into the sports, the equipment and apparatuses dedicated to the sports are becoming more and more technologically advanced or sophisticated.

Improving one's swing is one of the ways golf, tennis and baseball enthusiasts can increase their proficiency. There are special clubs, bats, and racquets as well as weights, video tapes and many other techniques for utilization during practice sessions. The extant learning devices are primarily based on the feedback the athlete receives from them and thus learn the correct technique while avoiding wrong techniques.

One of the more subtle difficulties encountered by most athletes is the grip pressure of the swing. There is no absolutely correct grip pressure of the swing. Trial and error is the only reliable way to discover the swing that produces the best result. Once that discovery is made the athlete needs to development muscle and grip memory in order to repeat the swing and hence replicate the desired result.

One device known in the art that helps the golfer in some sense memorize and repeat the same golf swing that produces the desired result is a glove worn on the hand of the user as described in U.S. Pat. No. 5,733,201 by the same inventor. While the glove unit is a highly accurate and desirable device, it has the inherent drawback that it is in the form of a glove. The glove is not interchangeable to allow use by either a right-handed or left-handed golfer, there is significant variation in sizing and the glove can not be made as durable as the monitoring instrumentation attached to it.

SUMMARY OF THE INSTANT INVENTION

The system used to monitor grip pressure is contained in a device analogous to a ordinary wrist watch. The back plate of the watch is in contact with the pulse pressure points on the wrist of the wearer. As hand grip pressure varies, as when gripping say a golf club handle, baseball bat, or tennis racquet, an electronic sensing device, a battery powered piezo sensor strip, for example a Tekscan FlexiForce® A201 Sensor (Tekscan, Inc., South Boston, Mass.) embedded in the watch casement, sends an electronic impulse to an A/D converter. The greater the force of the grip exerted by the wearer, the higher the grip pressure value recorded by the device, and conversely, the slighter the grip pressure, the lower the value.

The Tekscan FlexiForce® A201 Sensor is an ultra-thin and flexible printed circuit that can act as a force sensing resistor (e.g., a variable resistor) in an electrical circuit. It can measure force between two surfaces. When the force sensor is unloaded, its resistance is very high. When a force is applied to the sensor, this resistance decreases. The resistance can be read by connecting a multimeter or other circuitry to the outer two pins, then applying a force to the sensing area. As examples, force versus resistance or force versus conductance (1/R) may be measured where the conductance curve is linear, and therefore useful in calibration. One way to integrate the FlexiForce® sensor into an application is to incorporate it into a force-to-voltage circuit. The A201 model has a sensing area of about 0.375 inches in diameter with a response time of less than about 5 microseconds. The A201 model is available in various force ranges (e.g., 0-1 lb (4.4 N); 0-25 lb (110 N); and 0-100 lb (440 N)).

An LCD, deployed on the watch face, displays the grip pressure as a digital value. The system allows the wearer to SAVE a single grip pressure value in the memory. Subsequent grips are sequentially compared with the one saved in memory. The system compares each subsequent grip pressure value with the saved or benchmark grip pressure value. An audible signal alerts the wearer that he/she has used a different grip pressure from that saved. Additionally, visually, displayed on the watch face are arrows indicating a stronger or weaker grip.

BRIEF DESCRIPTION OF THE DRAWINGS

FIG. 1 displays the watch housing or casement and the pressure plate deployed at the back of the monitoring device. Note the pressure plate is made of thin metal and domed so as to more acutely sense subtle changes in the expansion and contraction of the muscles and tendons in the wrist of the wearer.

FIG. 3 is the layout of the LCD 300 showing the digital value display of the grip pressure, as well as the direction indicator of greater or lesser grip pressure than that SAVED in memory. This application of the instant invention is embodied in a multifunction application, hence the LCD illustrated displays two additional functions, swing speed and elapsed time of the swing.

FIG. 4 attempts to show the data collection process of the instant invention. From Tim0, or the start of a swing to Time=+1, or the finish of the swing, five discrete values for grip pressure, represented here by R1, . . . R5, can be recorded.

DESCRIPTION OF A PREFERRED EMBODIMENT

Figure 1:
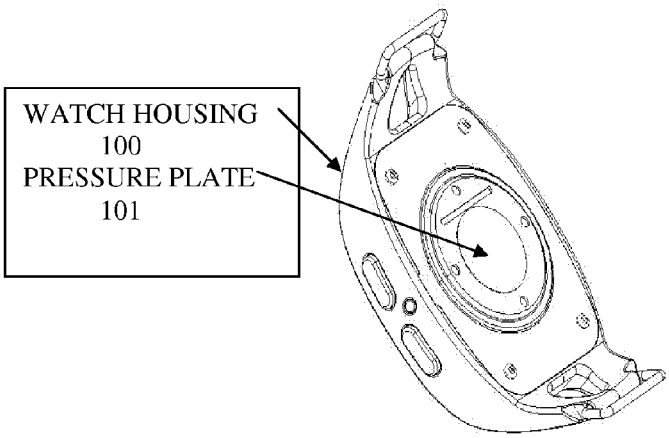
FIG. 1 is a schematic drawing of one embodiment of the watch housing 100 and back pressure plate of the instant invention 101. When deployed, the watch housing is held in close contact with the pulse point of wearer's wrist by a stretchable band secured by a hook and loop VELCRO® material fastener.

FIG. 1 is a representation of the outside housing 100 of the instant invention. The watch's back plate, 101 made of thin metal alloy is cinched securely to the wearer's wrist and makes contact with the pulse pressure points. The domed shape of the back plate is pliable. When the muscles and tendons in the wearer's wrist expand and contract as a result of variable grip pressure, the metal plate will similarly respond to the pressure emanating from the wearer's grip.

Figure 2:
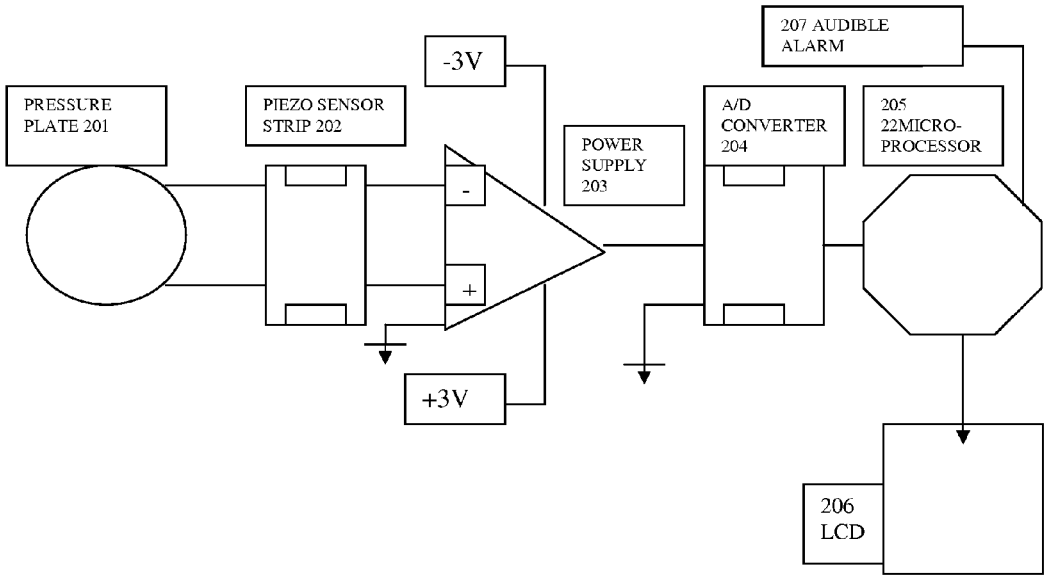
FIG. 2 is a block diagram of the monitoring circuit of the instant invention.
Figure 2:
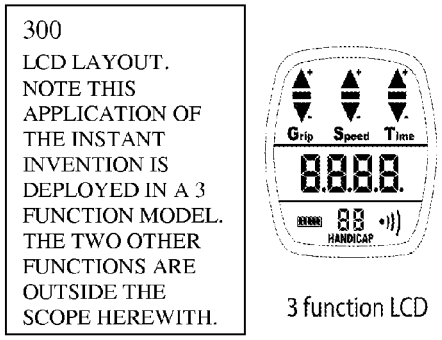

Inside the housing or watch casement are the various components arrayed in FIG. 2. Two very thin gauge electrical wires lead from a piezo sensor strip 202 and are soldered to the pressure plate 201. The piezo strip registers pressure differentials as the wearer's grip varies when swinging a golf club, cricket bat, squash racquet, or the like. The signal from the piezo sensor is driven by a 3 Volt battery 203 and thence to an A/D converter 204. The numeric values assigned to the corresponding pressure is somewhat arbitrary but they do reflect differing magnitudes, say in a range from one to ten with 10 being the maximum grip pressure recorded and 1 being the minimum amount of pressure a person could exert on the handle. The architecture of the software embedded in the microprocessor 205 transmits the grip pressure value to the LCD 206 signaling the user of the instant invention whether or not she or he has exerted the same grip pressure as on the swing they are trying to repeat. The signal is an audible alarm 207 or buzzer indicating a deviation from the pre-set grip pressure value from the best swing set in a previous trial.

FIG. 3 is relatively self explanatory except to note that the up and down icons on the LCD 300 render a non numeric representation of the direction of the deviation_in grip pressure from the benchmark or SAVED swing that the user is attempting to replicate. Obviously the up arrow indicates tighter grip pressure and the down arrow, lower or looser grip pressure.

FIG. 4 graphically depicts an idealize golf swing. Empirical data indicates that the arc of the swing in the down stroke generates a curvilinear distribution of grip pressures over time. The pressure sensor deployed in the instant invention is capable of capturing up to five discrete data points in this distribution. We have tested the hypothesis that grip pressure as measured by the instant invention is highest at approximately the point of contact with the ball, at point R3 in FIG. 4.

Our experiments and hypothesis testing have been limited to hitting a golf ball, but intuitively we might assume this will also hold true for swinging a baseball bat, tennis racquet, or the various other modes of swinging referred to above. Any one or some combination of the data points in the distribution may be used for the purposes of the golf application. Since the objective is to repeat the grip pressure on the swing that gives the best result, it has proven most reliable to take the arithmetic mean of the distribution as the indicator of each swing's grip pressure.

Thus the mean value of grip pressure is SAVED in the memory of the device and subsequent mean values of repeated trials are compared to the SAVED value. Deviations are signaled as identified above, and the mean grip pressure values, replicating those saved confirm that a successful swing has been completed.

The grip pressure sensor device in the preferred embodiment described here is in the form analogous to a wrist watch. This multi-function swing monitor is cinched tightly on the inside of the wrist in the pulse point area of the wearer by a stretchable band fastened by say, hook and loop VELCRO® material. On the back of the watch casement or housing is a domed shaped thin, pliable metal alloy plate which is, as noted, held in contact with the pulse points of the wearer by the watch strap/band.

A highly sensitive pressure sensor strip (e.g., a Tekscan FlexiForce® A201 Sensor) detects very subtle changes in grip pressure as the person wearing the device swings a golf club, baseball bat or some other mode of hand held equipment. The flexing and relaxing of the muscles and tendons in the wearer's wrist is detected, converted in to a digital value and can be saved in the memory of the swing monitor.

Grip pressure values from subsequent swings can be compared with that value SAVED in memory. Should a deviation in grip pressure be detected, an audible signal is activated, alerting the user they have failed to replicate the grip pressure on the SAVED or benchmark swing. This biofeedback is a time honored method of training and conditioning muscle memory.

As described herein, a device can include converter means connected intermediate each pressure sensor and electronic monitoring circuit. As described herein, a converter means can include an analog to digital signal converter. As described herein, an electronic monitoring circuit can include microprocessor means. As described herein, display means can include a liquid crystal display device. As described herein, a device can include alarm means connected to an electronic monitoring circuit. As described herein, alarm means may selectively provide an audible alarm signal. As described herein, alarm means may selectively provides a visual alarm signal. As described herein, a device can include switch means for selectively controlling the operation of an electronic monitoring circuit. As described herein, switch means can include reset switches connected to an electronic monitoring circuit and to display means. As described herein, a device can include position marking means on the front of said WATCH to assist in the positioning of a golf club relative to said strap during said golf swing.

As described herein, a self contained golf or any swing training device can include a WATCH or swing monitoring system adapted to be worn inside the wrist of the user, or at the pulse pressure point of the wearer, piezo pressure sensor, means mounted in said WATCH, means to measure the grip pressure exerted on a golf club, bat, racquet etc., during said swing.

The invention claimed is:

1. A watch comprising:

a wrist band; and a housing mounted to the wrist band wherein the housing comprises a wrist side and an opposing side, a pliable domed shape pressure plate that extends outwardly from the wrist side of the housing to contact a palm side of a wrist and that responds to movements of muscles and tendons in the wrist that correspond to varying grip pressures applied by a hand extending from the wrist, a battery, memory, circuitry powered by the battery to convert responses of the pliable domed shape pressure plate to digital data, and circuitry powered by the battery to record the digital data to the memory.

2. The watch of claim 1 further comprising a display to display one or more values based on the recorded digital data.

3. The watch of claim 1 further comprising an alarm.

4. The watch of claim 3 wherein the alarm comprises an audible alarm.

5. The watch of claim 3 wherein the alarm comprises a visual alarm.

6. The watch of claim 3 wherein the alarm responds to a deviation of one digital data value from another digital data value.

7. The watch of claim 6 wherein the alarm comprises an audible alarm.

8. The watch of claim 6 wherein the alarm comprises a visual alarm.

9. The watch of claim 1 wherein the pliable domed shape pressure plate comprises a metal plate.

10. The watch of claim 1 interchangeably mountable on a right wrist or a left wrist.

11. The watch of claim 1 further comprising a display to display an arrow to indicate a tighter grip pressure and an opposing arrow to indicate a looser grip pressure.

12. The watch of claim 1 further comprising a display to display a non numeric representation of a direction of a deviation of one digital data value from another digital data value.

13. The watch of claim 1 wherein the circuitry powered by the battery to record the digital data to the memory comprises circuitry to record discrete digital data values that correspond to varying grip pressures with respect to time.

14. The watch of claim 1 further comprising circuitry powered by the battery to perform a data collection process.

15. The watch of claim 1 wherein the wrist band is configurable on the wrist to maintain contact between the pliable domed shape pressure plate and the palm side of the wrist.

16. A data collection method comprising:

providing a watch mounted to a wrist wherein the watch comprises circuits, memory and a pliable domed shape pressure plate that contacts a palm side of the wrist and that responds to movements of muscles and tendons in the wrist that correspond to varying grip pressures applied by a hand extending from the wrist;

varying with respect to time grip pressures applied by the hand extending from the wrist;

converting to digital data responses of the pliable domed shape pressure plate to the varying grip pressures applied by the hand extending from the wrist using at least one of the circuits; and recording the digital data to the memory to provide a record of a distribution of grip pressures with respect to time using at least one of the circuits.

17. The method of claim 16 further comprising providing a display and displaying a non numeric representation of a direction of a deviation of one digital data value responsive to a grip pressure from another digital data value.

18. The method of claim 16 further comprising providing an alarm and indicating via the alarm that a digital data value responsive to a grip pressure deviates from another digital data value.

* * * * *